US007011157B2

(12) United States Patent
Costley et al.

(10) Patent No.: US 7,011,157 B2
(45) Date of Patent: Mar. 14, 2006

(54) METHOD AND APPARATUS FOR CLEANING A FRACTURED INTERVAL BETWEEN TWO PACKERS

(75) Inventors: James M. Costley, Freeport, TX (US); David M. Eslinger, Broken Arrow, OK (US); Randolph J. Sheffield, Hatton of Fintray (GB); L. Michael McKee, Friendswood, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 303 days.

(21) Appl. No.: 10/629,163

(22) Filed: Jul. 29, 2003

(65) Prior Publication Data

US 2004/0084187 A1 May 6, 2004

Related U.S. Application Data

(60) Provisional application No. 60/422,543, filed on Oct. 31, 2002.

(51) Int. Cl.
*E21B 33/124* (2006.01)
*E21B 37/00* (2006.01)

(52) U.S. Cl. ..... 166/311; 166/186; 166/191; 166/202; 166/386

(58) Field of Classification Search ..... 166/278, 166/281, 305.1, 308.1, 311, 373, 374, 381, 166/386, 142, 145, 151, 184, 186, 185, 202, 166/177.5, 333, 191
See application file for complete search history.

(56) References Cited

U.S. PATENT DOCUMENTS

| | | | | | |
|---|---|---|---|---|---|
| 2,059,631 | A | * | 11/1936 | Weldon | 166/145 |
| 2,073,126 | A | * | 3/1937 | Sweet | 166/116 |
| 2,098,494 | A | * | 11/1937 | Grant | 166/63 |
| 2,404,876 | A | * | 7/1946 | Granger | 166/147 |
| 2,426,164 | A | * | 8/1947 | Breukelman | 166/146 |
| 2,607,424 | A | * | 8/1952 | Taylor | 166/133 |
| 2,607,425 | A | * | 8/1952 | Taylor | 166/183 |
| 2,738,012 | A | * | 3/1956 | Springer | 166/146 |
| 2,897,897 | A | * | 8/1959 | Breukelman | 166/120 |
| 3,391,743 | A | * | 7/1968 | Bateman | 166/183 |

(Continued)

*Primary Examiner*—Jennifer H Gay
(74) *Attorney, Agent, or Firm*—David Cate; Wayne Kenak; Tim Curington

(57) ABSTRACT

A method and apparatus for fluid treatment of a selected interval of a well and then cleaning the selected interval and the apparatus of treatment residue. An straddle tool is run into the well to treatment depth on fluid supplying tubing and has upper and lower packers that establish sealing with the casing and define an annular interval between the packers and between the tool and casing. Fluid, such as fracturing fluid, is pumped through the tubing to the tool and is diverted through an outlet port of the tool into an upper portion of the annular interval. Fluid then flows from a lower portion of the annular interval through an inlet port below the outlet port and at low flow rate is dumped into the casing through a pressure responsive dump valve. The outlet port and inlet port are located to accomplish cleaning of residue from the packers.

28 Claims, 5 Drawing Sheets

U.S. PATENT DOCUMENTS 3,797,572 A * 3/1974 Mignotte ..... 166/127
4,765,405 A * 8/1988 Clark ..... 166/186
4,899,821 A * 2/1990 Casida ..... 166/312
5,443,117 A * 8/1995 Ross ..... 166/51
6,446,727 B1 9/2002 Zemlak et al.
6,533,037 B1 3/2003 Eslinger et al.
6,655,461 B1 * 12/2003 Eslinger et al. ..... 166/305.1
2002/0162660 A1 11/2002 Depiak et al.
2003/0019628 A1 * 1/2003 Ravensbergen et al. .... 166/308
2004/0084190 A1 * 5/2004 Hill et al. ..... 166/386
2004/0159447 A1 * 8/2004 Bissonnette et al. ..... 166/386
2004/0238173 A1 * 12/2004 Bissonnette et al. ..... 166/307

* cited by examiner

METHOD AND APPARATUS FOR CLEANING A FRACTURED INTERVAL BETWEEN TWO PACKERS

CROSS-REFERENCE TO RELATED APPLICATIONS

This application claims priority from Provisional Application 60/422,543, filed Oct. 31, 2002, which is incorporated herein by reference.

BACKGROUND OF THE INVENTION

1. Field of the Invention

This invention pertains generally to wells for production of petroleum products from subsurface earth formations and more particularly concerns completion systems for wells, including formation fracturing and other treatment for enhancement of well production. Even more specifically, the present invention concerns a method and apparatus for cleaning a fractured or otherwise treated perforated casing interval between spaced packers to permit repositioning or removal of the apparatus.

2. Description of Related Art

When a fracturing treatment is performed on a zone isolated by packers, two problems are prevalent: 1) erosion of the tool and casing due to high velocity flow of abrasive fluids, and 2) cleanup of slurry/proppant in the annular area between the casing and the isolation tool. This invention addresses both of these issues.

Conventional coiled tubing conveyed fracturing tools have spaced packer elements, such as cup packers, and typically provide a fracturing port or ports located just uphole from the lower packer element and a dump port (if used) that is located below the lower packer element. This arrangement works well when clean fluid is reverse circulated down the annulus and up the coiled tubing to clean underflushed slurry that is typically present in the coiled tubing and in the fracturing tool after fracturing a zone. The reverse circulated clean fluid flows over the upper packer, down the casing-tool annulus between the packers, into the tool via the fracturing port, and up the coiled tubing to the surface. By locating the fracturing port near the lower packer element, cleaning of the straddle interval between the packers is optimized.

On some jobs a fracturing tool is provided with a dump port, and clean flushing fluid is pumped down the coiled tubing to displace the underflushed slurry in the coiled tubing to the wellbore below the tool. According to this arrangement, which employs no reverse circulation, the slurry remaining in the annulus interval between the packers may not be effectively cleaned.

BRIEF SUMMARY OF THE INVENTION

It is a principal feature of the present invention to provide a straddle packer tool and method of its use for accomplishing downhole treatment of a selected interval in a manner and through the use of a system that minimizes erosive wear of well tool components by the abrasive action of slurry that is utilized during well treatment.

It is another feature of the present invention to provide a straddle packer tool that is designed with an out and in flow path from the tool to an annular interval between the tool and casing, which promotes efficient and effective cleaning of residual slurry and proppant from the annular interval and the straddle packer tool, thus enabling the tool to be easily moved to a different interval or to enable the tool to be easily extracted from the well.

It is also a feature of the present invention to provide a novel straddle packer tool that employs cup packer elements to straddle and seal a casing interval and has outlet and inlet ports so located relative to the cup packers as to provide for fluid flow cleaning of the packers and to displace any deposited proppant or other residue from the interior of the skirt of the lower packer.

As used herein, terms such as "up", "down", "upper", "lower", "top" and "bottom" and other like terms indicate relative positions of the various components of the straddle packer tool of the present invention with the tool vertically oriented as shown in the drawings. However, it should be borne in mind that the straddle packer tool of the present invention is designed for employment in wells having wellbore sections that are oriented vertically, that are highly deviated from the vertical, or may be oriented horizontally. Also, the terms "coiled tubing" or "tubing", as used herein, are intended to mean tubing strings of any character, including coiled tubing or jointed tubing, which are used to convey fracturing tools and other well treatment tools to selected zones or intervals within wells, especially wells having highly deviated or horizontal wellbore sections.

This invention addresses problems that exist when a well is fractured through coiled or jointed tubing to a tool isolated casing interval. An example of such fracturing is disclosed in U.S. Pat. No. 6,446,727, incorporated herein by reference, wherein fracturing fluid is pumped down coiled tubing to an area or interval of the wellbore isolated by two opposing cup packer elements. The present invention is, however, also applicable to treatments performed by a treatment tool that is conveyed by jointed pipe and to isolated intervals created with mechanically set straddle packers and inflatable straddle packers. A dump valve as used in connection with well treatment activities, such as formation fracturing, may be of the type set forth in U.S. Pat. No. 6,533,037, also incorporated herein by reference.

To solve the erosion and fracture annulus cleanout problems a downhole straddle packer tool is provided, having an outlet mandrel or tool section at its upper end and an inlet mandrel or tool section at its lower end, with the outlet and inlet mandrels being interconnected by a tubular straddle spacer of sufficient length to bridge a selected casing interval which is typically perforated for completing the well to a petroleum containing subsurface zone. The outlet and inlet mandrels are provided, respectively, with upper and lower packer elements, which are preferably cup packer elements, and which establish sealing between the straddle tool and the casing responsive to pressure in the casing-tool annulus of the selected interval. The outlet and inlet mandrels or tool sections cooperatively define an out and in flow path to and from the selected interval through which clean fluid is caused to flow to clean away blockage or deposits of slurry and proppant from the annular fracturing or treatment zone or area between the packer elements. The outlet and inlet ports of the straddle tool are located in mandrels or tool sections which integrate bypass ports, slurry ports, and packer cup element mounting. This integrated component tool assembly enables the mandrel sections of the tool to be provided with flow passage bores of large dimension, as compared with conventional fracturing tools, for reduced slurry velocity, resulting in tool passage flow rates that are lower than usual. Such low velocity fluid flow results in minimized tool component erosion by the typically abrasive solid particulate constituents of the treatment fluid. The integrated component tool assembly also allows a portion of the outlet port of the tool to be located immediately below the upper cup packer element and allows the inlet port to have a portion thereof located under the lower cup packer element skirt, so as to flush away particulate from within the upwardly facing lower cup packer to maximize annular cleanup of residual treatment slurry. The straddle tool may also employ a shunt tube having one or more flow operated valves situated along the length thereof to assist annular slurry cleanup by porting clean fluid to annular areas that may be blocked by well treatment slurry.

The out and in flow path of the straddle tool also greatly reduces erosion of the straddle tool and the casing opposing the outlet port. The out and in configuration of the tool causes the flow path of the abrasive proppant laden formation fracturing slurry to have two gentle bends as the fluid flow is diverted from the tool bore through the outlet port and into the casing-tool annulus. This gentle bend flow diverting characteristic is in contrast to the two abrupt 90 degree bends of the fluid flow path that are employed in typical prior art straddle packer formation fracturing tool designs. A specially shaped diverter plug is located in the outlet mandrel of the tool and functions to channel slurry from the tool bore through the outlet port and into the casing-tool annulus. This diverter plug is fabricated from a sacrificial material that erodes at a prescribed rate in the presence of flowing proppant-laden fracturing fluid. This controlled erosion of the diverter plug, as it assists the port geometry in diverting fluid from the outlet mandrel, through the outlet port, and into the annulus between the well casing and the tool, distributes impingement of the flowing fluid to a larger surface area of the tool and the well casing than is usually the case and minimizes the velocity of the fluid flow and the erosion damage on the outlet mandrel ports and the well casing, resulting in increased tool component life.

The diverter plug is shaped to direct the flow traveling between the outlet ports into the exit stream. Without this shape, high velocity fluid travels between the ports to the bottom of the outlet port slot and then makes an abrupt turn to exit the outlet port with the other fluid. This sudden change of direction and the increased flow rate caused by more fluid exiting the bottom of the outlet port slot, increases erosion at the bottom edge of the outlet port. This uncontrolled erosion can rapidly cut through the sidewall of the outlet port and can eventually cut into the bypass ports or passages of the tool. This event terminates the well servicing procedure and greatly increases the potential for the tool getting stuck in the well. In addition, the diverter plug is composed of a sacrificial material and is designed to erode at a prescribed rate. The high velocity slurry of the fracturing job erodes the diverter as it is redirected through the outlet ports. The high velocity fluid resists this redirection and as a result more fluid exits the port at the diverter plug interface. More flow means higher velocity, which also means the erosion rate of the out sub is greatest near the diverter plug interface. As the diverter plug erodes, the location of the diverter-out sub interface moves down the port distributing the erosion over a large portion of the port. This controlled erosion increases out sub life. The rate of erosion of the diverter valve can be changed by the use of different materials, various treatments to the material, such as hardness, and by changes in geometry (impingement angle).

BRIEF DESCRIPTION OF THE DRAWINGS

The present invention may be understood by reference to the following description taken in conjunction with the accompanying drawings in which.

DETAILED DESCRIPTION OF THE INVENTION

Figure 1:
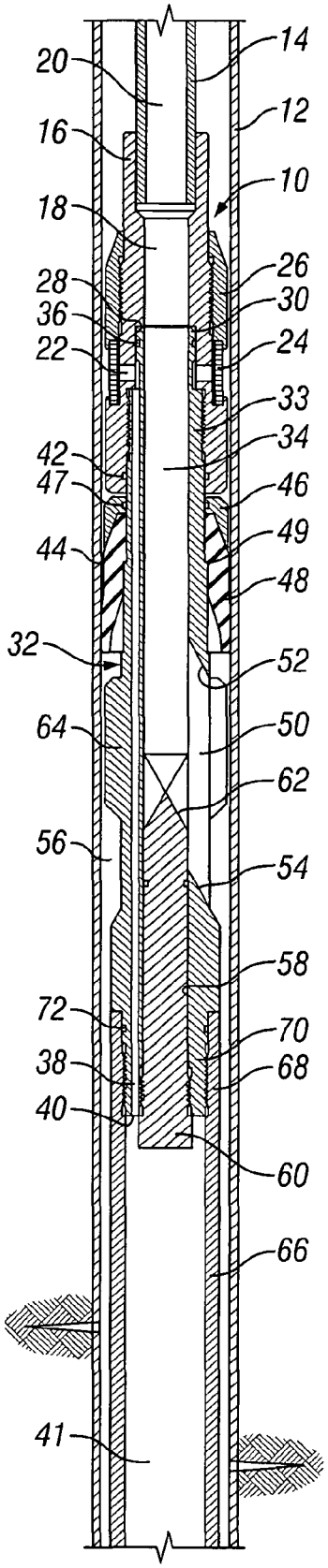
FIG. 1 is a sectional view showing the upper section of the straddle tool of the present invention.

Referring now to the drawings and first to FIGS. 1–4, a straddle tool embodying the principles of the present invention is shown generally at 10 and is shown located within a well casing 12. A tubing string 14, such as a string of coiled tubing, handled by a tubing conveyance system, is run into the wellbore to convey the straddle tool 10 to the location of the casing perforations that communicate with the subsurface zone to be subjected to fracturing or other treatment. The tubing string 14 is mounted to a tool coupling member 16 which defines a flow passage 18 that is in communication with a flow passage 20 of the tubing string 14. The tool coupling member 16 defines a plurality of by-pass ports 22 that are surrounded by a by-pass screen 24 which is secured within a screen seat by a screen retainer element 26 that is threaded to the tool coupling member 16. The tool coupling member 16 defines an annular internal pocket 28 that receives the upper tubular end 30 of a tubular outlet mandrel, shown generally at 32, having a tubular member 33 defining an internal flow passage 34 through which fluid is conducted from the flow passage 20 of the tubing string 14 and the flow passage 18 of the tool coupling member 16. The upper tubular end 30 of the tubular outlet mandrel 32 is sealed to an internal pocket wall of the annular internal pocket 28 by an annular sealing member 36.

The tubular outlet mandrel 32 defines at least one elongate bypass passage 38 having a bypass opening 40 at its lower end into which bypassed fluid is communicated from a passage 41 of a tubular straddle spacer 66 as discussed below. The upper end portion of the tubular outlet mandrel 32 is threaded into the tool coupling member 16 as shown in FIG. 1 and is sealed therewith by an annular O-ring type sealing member 42. In the region of the bypass outlet ports 22, the tubular member 33 is machined to define an annular groove that communicates the bypass passage or passages 38 with the bypass outlet ports 22.

The tubular member 33 of the outlet mandrel 32 provides support for an upper cup packer assembly 44, which is preferably a cup packer element having a rigid packer support section 46 that is sealed to the fluid conducting tubular member 33 by an annular seal member 47. The upper cup packer assembly 44 also includes a flexible packer cup 48 which is seated on an annular retainer shoulder 49 to thus stabilize the position of the upper cup packer assembly 44 relative to the tubular member 33.

The tubular outlet mandrel or sub 32 is machined or otherwise formed to define an outlet port 50 that is in communication with the internal flow passage 34 of the tubular member 33. The geometry of the outlet port 50 achieves a gentle or smooth transition from the flow passage 34 in that its upper and lower ends are defined by angulated flow transition surfaces 52 and 54 respectively. By avoiding the abrupt transition of fluid flow from the flow passage 34 to the annulus 56 between the straddle tool 10 and the internal surface of the well casing 12 wear erosion of surface portions of the outlet port geometry as well as other tool and well components is minimized.

The lower portion of the central passage of the tubular outlet mandrel 32 defines a receptacle 58 within which is located an elongate diverter plug 60 which is composed of a sacrificial material that is designed to erode in a controlled manner as proppant-laden fluid is caused to flow at relatively high velocity in contact with the upper end of the diverter plug 60. The upper end of the diverter plug 60 has an inclined flow diverting surface 62 that further enhances gradual rather than abrupt diversion of the flow of high velocity fluid or proppant-laden fluid from the internal flow passage 34 through the inclined outlet port 50 into the annulus 56 between the tool and casing.

Figure 8:
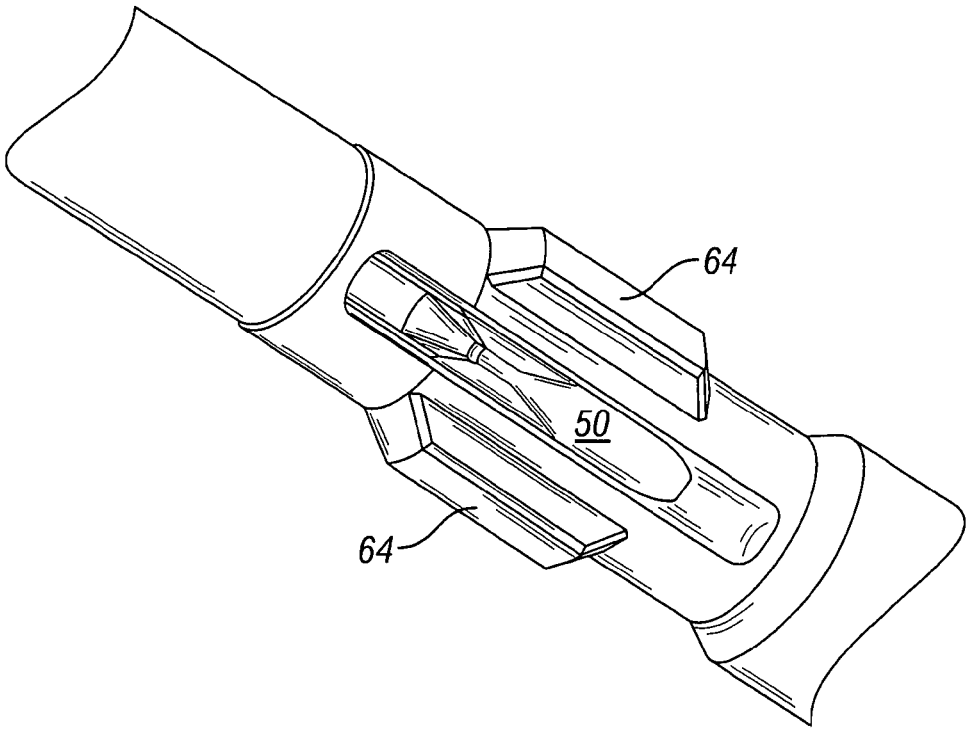
FIG. 8 is an isometric illustration of an upper section of the straddle tool of the present invention showing a portion of the specially shaped erodible diverter tube located therein.
Figure 9:
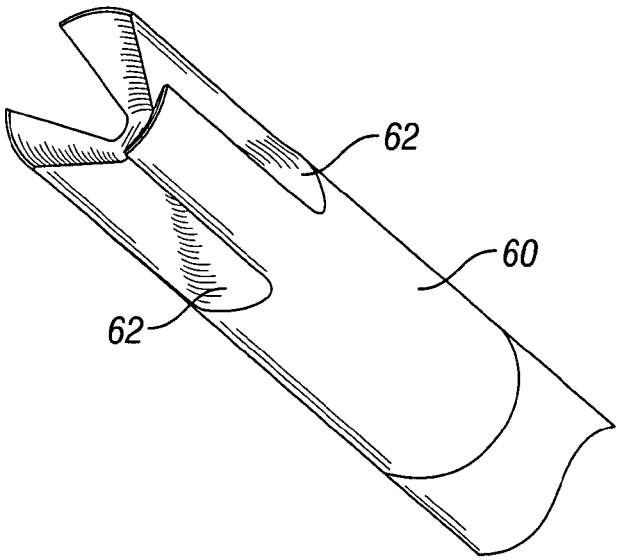
FIG. 9 is an isometric illustration of the specially shaped erodible diverter plug, showing the geometry of the diverter tube section thereof.

The tubular outlet mandrel 32 defines a plurality of centralizing bosses 64 that are angularly spaced relative to one another and defined flow passages therebetween to permit efficient flow of fluid through the annulus between the straddle tool 10 and the well casing 12. The centralizing bosses 64 are of a dimension establishing relatively close fitting relation with the internal surface of the well casing 12, thereby centralizing the straddle tool 10 within the well casing 12. This tool centralizing feature is evident from an inspection of FIG. 8.

Figure 2:
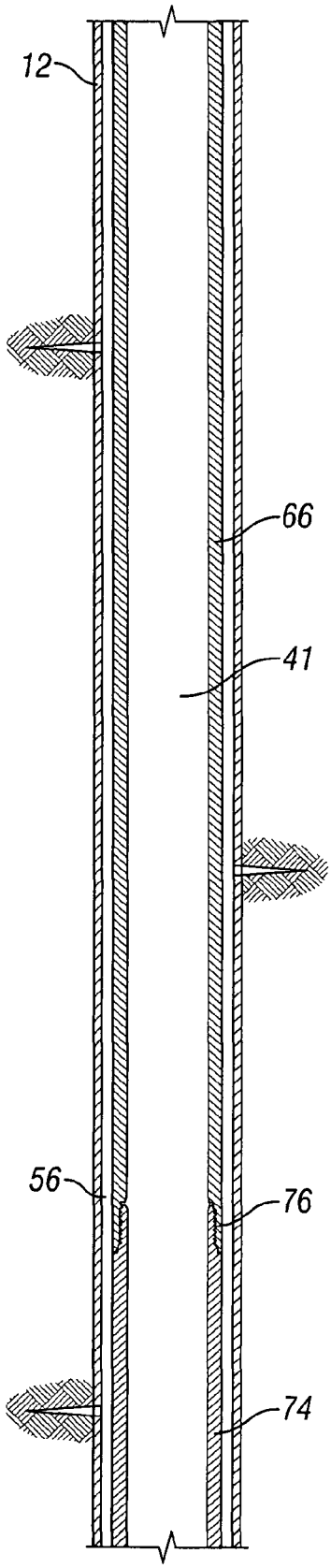
FIG. 2 is a sectional view showing the middle or intermediate section of the straddle tool of the present invention.

A tubular straddle spacer 66, which defines the passage 41, is provided with an upper end portion 68 that is disposed in threaded engagement with a tubular lower section 70 of the tubular outlet mandrel 32 and is sealed therewith by one or more annular sealing elements 72. Depending on the length of the perforated portion of the well casing 12 that is intended to be straddled by cup packers, the tubular straddle spacer 66 may be composed of a single length of tubular material or, as shown in FIG. 2, it may include additional lengths of tubular material 74 that are interconnected by threaded connections such as is shown at 76. The annulus 56 between the straddle tool 10 and the well casing 12 extends along the tubular straddle spacer 66 as is evident from FIG. 2, thereby permitting a condition of fluid flow to occur in the annulus 56 to thus provide for the flow of high pressure fracturing or other well treatment fluid to the various casing perforations that exist within the designated production interval.

Figure 3:
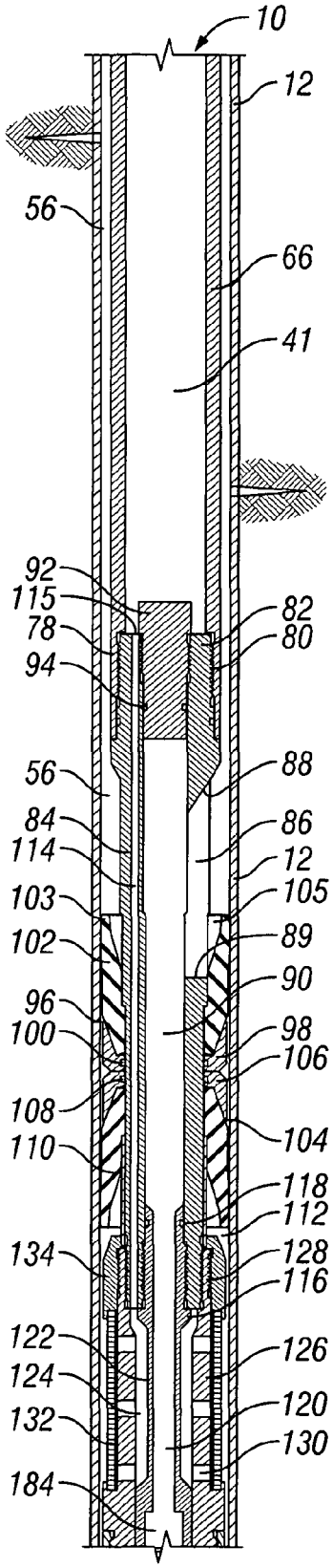
FIG. 3 is a sectional view showing the lower section of the straddle tool of the present invention.
Figure 4:
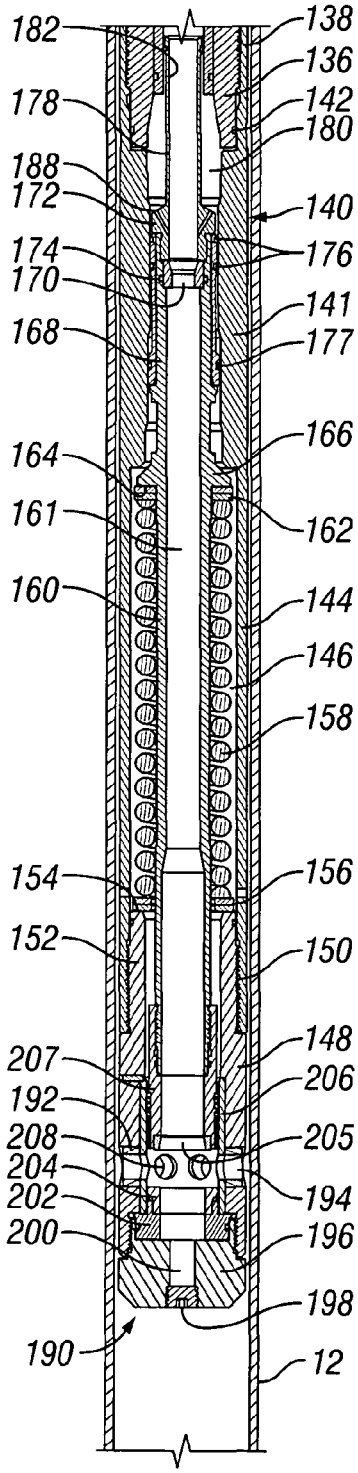
FIG. 4 is a sectional view showing a dump valve which is integral to the operation of the straddle system when using slurry.

As shown in FIG. 3, the lower end 78 of the tubular straddle spacer 66 or 74 as the case may be is secured by a threaded connection 80 to an upper connecting section 82 of a tubular inlet mandrel, shown generally at 84, having an inlet port 86 having a portion of the geometry thereof defined by an inclined flow diverting surface 88 that assists in the gentle transition of flowing fluid from the annulus 56 through the inlet port 86 and into an internal flow passage 90. To confine the inflowing fluid to the flow passage 90 a plug member 92 is secured by threaded engagement within the upper connecting section 82 of the tubular inlet mandrel 84 and is sealed relative thereto by an annular sealing member 94. Although the straddle tool 10 of the present invention is described herein as having an upper outlet mandrel defining an outlet port and a lower inlet mandrel defining an inlet port, and being interconnected, such as by a tubular straddle spacer 66, it is not intended to limit the scope of the present invention to such arrangement. If desired, an integral elongate straddle tool may be employed which defines both the outlet port and the inlet port and a displaced fluid bypass passage and is provided with packer elements for sealing within a well casing to provide for well treatment and tool and interval cleaning according to the principles of the present invention.

A lower cup packer assembly 96 is mounted to the tubular inlet mandrel 84 and includes a rigid cup support structure 98 that is sealed to the tubular inlet mandrel 84 by an annular sealing member 100. The lower cup packer assembly 96 also includes a flexible packer cup 102 that is supported by the rigid cup support 98 and expands responsive to fluid pressure for efficient sealing with respect to the well casing 12. The lower cup packer assembly 96 is disposed in oppositely facing relation with the upper cup packer assembly 44. When oriented vertically, such as shown in FIG. 3, the annular skirt 103 faces upwardly and defines an annular pocket 105 within which proppant or other slurry material often settles. To facilitate cleaning of settled proppant from the pocket of the lower cup packer, the lower end 89 of the inlet port 86 is located below the annular skirt 103 of the lower cup packer 102 so that fluid flowing through the inlet port 86 is directed into the pocket 105 and displaces any settled material therefrom. Moreover, a portion of the lower cup packer 102 defines a portion of the inlet port 86 in that it serves to guide the flow of fluid in gently diverted fashion as the fluid enters the inlet port 86 from the annular interval 56. A similar but oppositely facing lower cup packer assembly 104 is located immediately below the cup packer assembly 96 and includes a rigid cup support member 106 that is sealed to the tubular inlet mandrel 84 by an annular seal member 108. A flexible packer cup 110 is supported by the rigid cup support 106 and expands responsive to pressure within the well casing-tool annulus 112 below the tool, for sealing the straddle tool 10 within the well casing 12.

The tubular inlet mandrel 84 defines one or more bypass passages 114 having a bypass opening 115 through which displaced fluid from the casing below the lower cup packers 102 and 110 is caused to flow into the flow passage 41 of the tubular straddle spacer 66. A bypass tube 116 is threaded into the lower end of the tubular inlet mandrel 84 and is sealed therewith by an annular seal member 118. The bypass tube 116 defines a central flow passage 120 which is also referred to herein as a dump passage. Below the tubular inlet mandrel 84 the bypass tube 116 defines a reduced diameter section 122 that establishes an annular bypass passage section 124 with respect to the inner wall surface of a tubular bypass inlet section 126 having its upper tubular end 128 threaded externally of the lower end of the tubular inlet mandrel 84. A plurality of bypass inlet ports 130 communicate the annular bypass passage section 124 with the casing-tool annulus 112. An annular screen member 132 is retained within an annular screen seat and is positioned to screen displaced fluid at the bypass entrance. It should be borne in mind that the proppant or other particulate content of the mixture of treatment fluid and clean fluid that is discharged into the casing from the dump valve during the tool and interval cleaning process typically quickly settles out. Thus, any fluid that is displaced through the bypass passage to the casing above the tool is clean to the extent that it contains virtually no proppant. The screen member 132 is secured in place by a screen retainer element 134 that is threaded to the upper tubular end 128 of the tubular bypass inlet section 126.

The tubular bypass inlet section 126, as shown in FIG. 3, defines a lower tubular extension 136 to which the upper tubular connecting end 138 of a dump valve, shown generally at 140, is threadedly connected. The dump valve 140 may be of the type that is set forth in U.S. Pat. No. 6,533,037, which is incorporated herein by reference. The dump valve 140 includes a tubular valve actuator body section 141 having its upper end threaded to the lower tubular extension 136 of the tubular bypass inlet section or sub 126. An annular seal member 142 maintains sealing between the tubular bypass inlet section 126 and the tubular valve actuator body section 141. The valve actuator body section 141 includes a depending tubular connector section 144 that defines a spring chamber 146 and provides connecting support for a dump valve head 148 via a threaded connection 150. A tubular connecting section 152 of the dump valve head 148 defines an annular support shoulder 154 on which is seated one or more annular spring support washer elements 156 that accommodate the slight twisting movement of the spring 158 as it is compressed and relaxed. The helical compression spring 158 is located within the spring chamber 146, with its lower end in supported engagement with the spring support washers 156. The compression spring 158 surrounds an elongate tubular valve actuator member 160, with the upper end of the spring 158 disposed in force transmitting engagement with washer members 162 that are seated on an annular support shoulder 164 of an enlargement or flange 166 that is integral with or fixed to the elongate tubular valve actuator member 160. The valve actuator member 160 defines a flow passage 161. The lower end of the valve actuator member 160 is attached to the valve carrier 207 which rigidly holds the valve element 205.

A tubular section 168 of the tubular valve actuator member 160 extends upwardly from the annular enlargement or flange 166 and is located within an internal bore or passage of the tubular body section 141 of the dump valve 140 and defines an orifice seat in its upper end within which a flow control orifice member 170 is seated. A retainer member 172 is threaded to the upper end of the tubular section 168 and retains the flow control orifice member 170 within its seat. The orifice member 170 is sealed with respect to the orifice seat by an annular sealing member 174. Other annular sealing members 176 and 177 ensure the maintenance of a sealed relationship of the tubular section with respect to the dump valve 140. Annular sealing members 176 and 177 may be used singularly or in tandem to effect the effective piston diameter of tubular section 168.

A tubular scraper member 178 is mounted to the retainer member 172 and extends upwardly through an annular cavity 180 and is arranged with its upper generally cylindrical end 182 located for reciprocating movement within a cavity 184 that is located at the lower end of the bypass tube 116. The scraper member 178 moves within the cavity 184 during compression and relaxing movement of the spring member 158 and functions to exclude any accumulation of proppant or other slurry component that might be present on the wall surface or within the cavity 184 from annular cavity 180. The retainer member 172 defines a plurality of inclined passages 188 that maintain the annular cavity 180 balanced with the casing pressure that is present within the spring chamber 146. Thus, the required pressure differential across the orifice 170 to achieve compression of the spring 158 for valve opening actuation is determined relative to casing pressure. Further, as taught in U.S. Pat. No. 6,533,037, the dump valve actuating mechanism may incorporate two or more flow restricting orifices to control the free fall rate of fluid flowing through the dump valve and into the casing.

The dump valve head 148 defines a housing component for a dump valve assembly shown generally at 190. A plurality of dump orifice members 192, each defining a dump port 194, are located within respective orifice openings of the dump valve head 148. The dump orifices 192 are preferably composed of a hardened material, such as Stellite (mark of Deloro Stellite Inc. of Goshen, Ind., U.S.A.), which resists wear or erosion as abrasive proppant laden fluid is caused to flow therethrough. At the lower end of the dump valve head 148 is provided a retainer cap 196 having a drain plug 198 that is removable to permit fluid to drain from a drain passage 200 after the tool has been retrieved from the well. The retainer cap 196 is threaded into the lower end of the dump valve head 148 and serves to retain a seat support member 202 and a valve seat 204 in position within the dump valve assembly. The retainer member 196 also serves to retain a dump sleeve member 206 within the dump valve head 148. The dump sleeve member 206 defines a plurality of flow ports 208 in fluid communicating relation with the respective dump ports 194.

Operation

To perform a fracturing job with the straddle tool, a dump valve is attached to the bottom of the straddle tool and the straddle tool is connected to coiled tubing. Other tools such as disconnects may also be connected within the tool string as needed. The tool string is inserted into a well and run to treatment depth on coiled tubing. The depth of the tool is adjusted with the coiled tubing so that the cup packer elements straddle, and thus isolate, the zone or interval to be treated. Fluid for cleaning of a selected interval is pumped down the flow passage 20 of the tubing string 14 and along a fluid path that is down the outlet mandrel flow passages 18 and 34, out the outlet port 50 into the upper portion of the casing-tool annulus 56, down the casing-tool annulus 56 to its lower portion, in the inlet port 86 to the internal flow passage 90, through the flow passage 161 of dump valve 140 of FIG. 4, out the dump ports 194, up the casing-dump valve annulus, in the tubular bypass inlet section 126 through the bypass inlet ports 130, through the bypass passage 114, through the passage 41 of the tubular straddle spacer 66 of FIG. 2, out the bypass outlet ports 22 of the tool coupling member 16, and up the casing-tubing annulus.

During a formation fracturing procedure, as pump rate increases, a pressure drop is created across orifice 170 in the dump valve 140. At a prescribed flow rate, a differential pressure created across the orifice 170 develops sufficient force to overcome the opposing force of spring 158 and shift the valve actuator member 160 down, causing the valve element 205 to engage the valve seat 204, closing the flow path to the dump ports 194. Once the dump ports 194 are closed, the fracturing fluid pressure builds until the formation rock fractures, providing a new flow path for the slurry to cause propagation of the proppant-laden slurry into the fracture or fractures. The slurry flow path is down the tubing string 14 to the flow passage sections 18 and 34, out the outlet port 50, down the casing-tool annulus 56 of the interval to be subjected to fracture pressure, and through perforations in the casing 12 into the fractures that develop in the formation.

After the fracture treatment has been completed, slurry which was not pumped into the fractures of the formation will remain in the casing-tool annulus 56, in the tool passages, and in the flow passage 20 of the tubing string 14. In some cases the fracture 'screens out' before all of the slurry is displaced from the tubing and high concentration slurry or dehydrated proppant is left in the casing-tool annulus 56 and in the lower portion of the tubing string 14. In both cases this proppant-laden fluid must be removed from the tubing and the casing-tool annulus 56 before the straddle tool 10 is moved to the next zone or retrieved from the well.

When the fracture treatment has been completed, pump pressure is reduced to a predetermined level, often zero, and the dump valve 140 is opened by the force of its spring 158. The open dump valve 140 provides a flow path for displacing the slurry left in the tool and tubing into the 'rat hole' below the dump valve. Clean fluid is pumped down the tubing string 14, out the outlet port 50, down the casing-tool annulus 56, in the inlet port 86, through the dump valve 140 and out the dump ports 194. Especially when mixed with clean fluid, the proppant of the treatment fluid settles out and is filtered out of the fluid, allowing clean fluid to return through the bypass passage 114 and bypass inlet ports 130 and bypass outlet ports 22 and then up the casing-tubing annulus. This flow path of clean fluid cleans the remaining proppant from the straddle tool 10 and treatment area or casing-tool annulus 56, thus allowing the tool to be moved to the next location or retrieved from the well.

The out and in flow path that occurs through use of the present invention allows the clean up fluid to sweep the casing-tool annulus of any remaining proppant. Prior designs can only provide this type of cleanout if clean fluid is pumped down the casing-tubing annulus and back up the coiled tubing (reverse circulation). Reverse circulation is not possible in underbalanced wells, can cause damage to formations located above the straddle tool, and requires more time than pumping directly down the tubing to accomplish slurry clean up.

The outlet port 50 and inlet port 86 of the straddle tool 10 are located in a mandrel or connected mandrel sections which integrate bypass ports, slurry ports and cup packer element mounting. This integrated component arrangement provides a larger bore than usual for reduced slurry velocity (resulting in reduced erosion). This design allows the outlet port 50 to be located immediately below the upper cup packer 48, which improves cleanout by insuring that all perforations and screened out proppant are below the outlet port 50 and in the flow path of the cleanup fluid. The inlet port 86 is located under the lower cup packer 102 which causes the flow of clean fluid into the open upper end of the lower cup skirt 103 at sufficient velocity to displace slurry and proppant that might be present in the pocket 105 that is defined by the lower cup skirt 103, solving a problem which currently exists on all straddle fracturing systems using a lower cup packer element.

The straddle tool 10 may also use a shunt tube 296 (FIGS. 5 and 6) to assist casing-tool annulus cleanup by porting clean fluid to the casing-tool annulus areas that may be blocked with slurry. During the fracturing treatment, the high treating flow rate (treating pressure may be used) keeps the diverter valve 276 closed. Another design option is to attach the diverter valve 276 to the dump valve 140, so that the diverter valve 276 will be open when the dump valve 140 is open and closed when the dump valve 140 is closed. After completion of the fracturing procedure, the flow rate is reduced to a low rate (often 1–2 barrels per minute). At this low flow rate the diverter valve 276 is opened by its return spring 284. This allows flow through the shunt tube 296, which connects the outlet mandrel with the inlet mandrel through the center portion of the spacer housings. If flow through the casing-tool annulus is impeded or blocked, flow will pass through the shunt tube 296 and provide clean fluid to the dump valve 140 and the inlet mandrel 332. This will clean the lowest portion of the tool string.

Connected at intervals along the shunt tube 296 are flow operated shunt valves which provide a flow path, for the clean fluid, into the casing-tool annulus. A flow operated valve is also attached at the end of the shunt tube. As soon as the inlet mandrel and the dump valve are cleaned up, the resistance to flow will decrease and the flow rate through the end valve will increase. This increased flow will close the valve. The pressure of the cleanup fluid will increase until another flow path is established through the casing-tool annulus. As this flow path becomes clean, the rate will again increase until the flow operated valve closes. The process continues until the entire annular area is cleaned up.

The out and in flow path reduces erosion of the straddle tool and the casing opposing the outlet port. The out and in configuration requires the abrasive fracturing slurry to make two gentle bends when it is diverted from the tubing bore to the casing-tool annulus. This is in contrast to the two 90 degree turns employed in conventional designs. Abrasive fluid causes significantly more erosion when the flow is normal to the part being eroded. It has been shown that shallow angles of impingement greatly reduce the amount of erosion.

Figure 5:
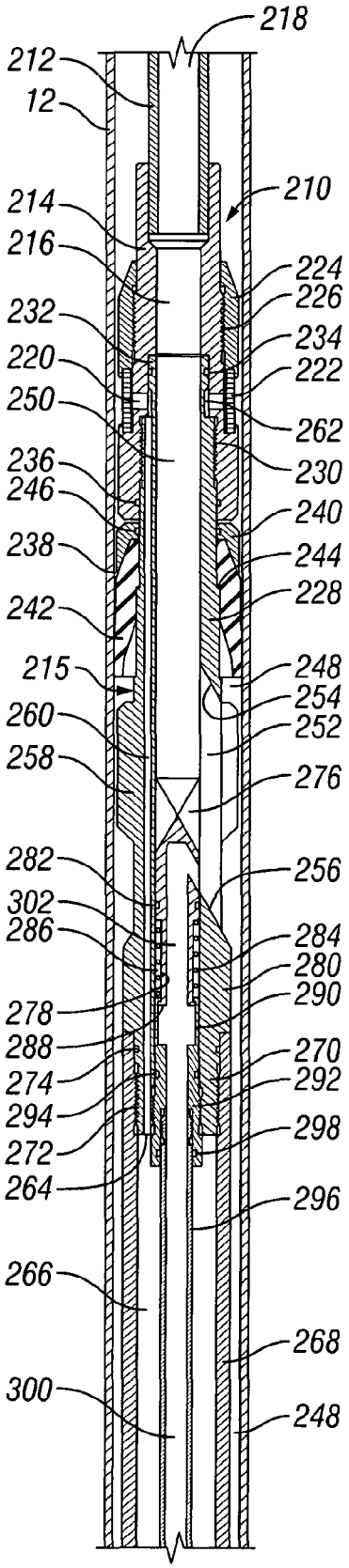
FIG. 5 is a sectional view showing an alternative embodiment of the present invention having an tool mandrel or mandrels as in FIGS. 1–4 and a diverter valve, shown in the open position thereof, and further showing the upper section of a shunt tube.
Figure 6:
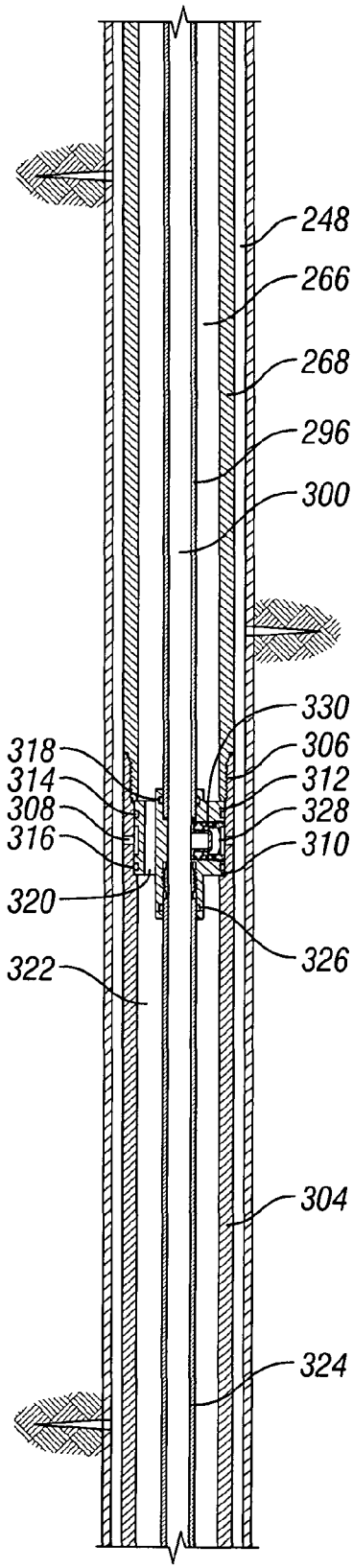
FIG. 6 is a sectional view showing an intermediate section of the alternative embodiment of FIG. 5, with one or more flow operated shunt valves located along the length of the shunt tube for porting clean fluid to an annular area that may be blocked with treatment fluid slurry or proppant.
Figure 7:
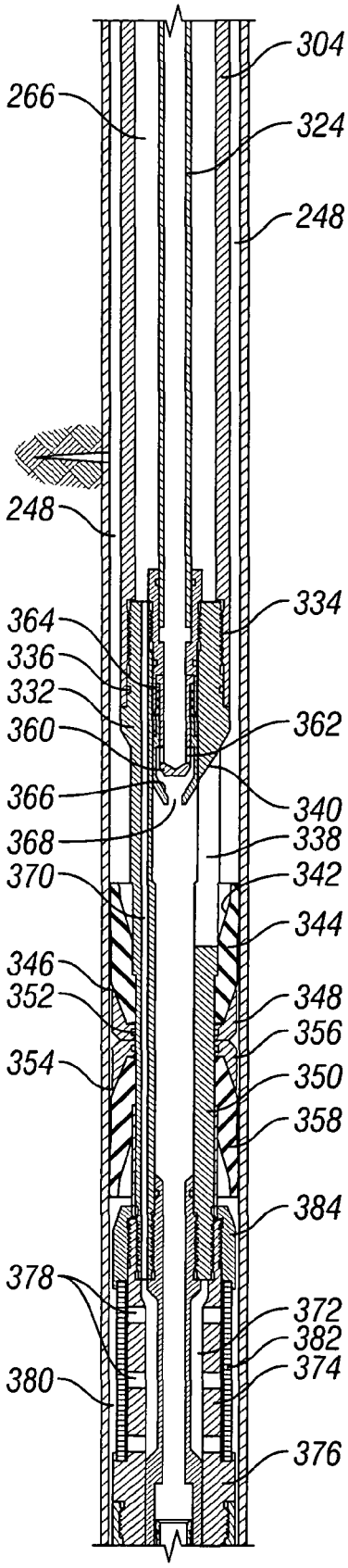
FIG. 7 is a sectional view showing a lower section of the shunt tube and shunt valve embodiment of FIGS. 5 and 6, having a flow control sub, with a flow operated valve incorporated within the sub.

Referring now to FIGS. 5–7, which illustrate an alternative embodiment of the present invention, a straddle tool is shown generally at 210 positioned within the well casing 12 and is conveyed to a desired treatment interval within the casing by a fluid supplying tubing string 212. The tubing string 212 is preferably composed of coiled tubing that is run and retrieved by a conventional coiled tubing deployment system, but if desired may be defined by connected tubing joints. The upper portion of the straddle tool 210 is defined by an outlet mandrel shown generally at 215 that is connected to the tubing string 212 by a coupling member 214 having a flow passage 216 that is in communication with a flow passage 218 of the tubing string 212. The coupling member 214 defines a plurality of bypass exit ports 220 and an annular bypass screen 222 is positioned to screen out particulate that might otherwise enter the bypass ports 220. The bypass screen 222 is of annular configuration and is retained within an annular screen seat by a screen retainer member 224 that is threaded to the coupling member 214 by a thread connection 226. The upper end 228 of outlet mandrel 215 engages coupling member 214 at thread connection 230. The reduced diameter upper tubular end 232 of outlet mandrel 215 is seated within a downwardly opening pocket of coupling member 214 and is sealed therewith by an annular seal 234. An annular seal 236 establishes sealing of the tubular outlet mandrel 215 with the coupling member 214 below the thread connection 230. An upper cup packer assembly 238 having a rigid cup support 240 and a flexible cup element 242 is seated relative to a packer positioning shoulder 244 and is maintained in sealed relation with the upper end 228 of outlet mandrel 215 by an annular sealing member 246. The flexible cup element 242 is pressure responsive to pressure within the annulus 248 between the tubular outlet mandrel 215 and the well casing 12. The flexible cup element 242 is expanded by annulus pressure within the selected interval and establishes a tight sealing engagement with the inner surface of the well casing 12.

Tubular outlet mandrel 215 defines an internal fluid supply flow passage 250 that is in communication with the flow passage 216 of the coupling member 214 and the flow passage 218 of the tubing string 212. Thus, fluid pumped through the flow passage 218 of the tubing string 212 will flow into the internal fluid supply flow passage 250 and will then be diverted through outlet port 252 into the interval annulus 248. The outlet port 252 is defined in part by inclined flow diverting surfaces 254 and 256 that establish a gentle angular transition of flowing, proppant-laden fluid into the interval annulus 248. Since no abrupt fluid transition occurs as the flowing proppant-laden fluid is diverted into the annulus 248 from the flow passage 250, the degree of wear or erosion of the outlet port surfaces will be minimized. The outlet mandrel 215 is centralized within the well casing 12 by a plurality of centralizing bosses 258 of the nature shown at 64 in FIG. 8.

Outlet mandrel 215 defines an elongate bypass passage 260 that is in communication with the bypass exit ports 220 by means of an annular recess 262 that is defined by the upper tubular end 232 of outlet mandrel 215. The bypass passage 260 defines a bypass exit opening 264 that is in communication within an annular passage 266 below outlet mandrel 215. A tubular straddle spacer 268 is connected to a lower end section 270 of outlet mandrel 215 by a threaded connection 272 and is sealed with respect to the tubular outlet mandrel 215 by an annular seal member 274.

A diverter valve 276 is linearly movable within a central passage 278 that is a continuation of the internal flow passage 250 and is defined within the lower end section 280 of the tubular outlet mandrel 215. The diverter valve 276 is sealed within the central passage 278 by an annular seal member 282 and is urged upwardly to an open position by a return spring 284 that is located within an annular spring chamber 286 that is defined between the diverter valve and the wall surface of the central passage 278. Upward movement of the diverter valve 276 is limited by an annular internal stop shoulder 288 that is defined by an upper tubular extension 290 of an internal coupling member 292 that is threaded within the lower end section 270 of outlet mandrel 215. The internal coupling member 292 is sealed within the lower end section 270 by an annular seal member 294. A shunt tube 296 establishes a threaded connection with the internal coupling member 292 and is sealed with respect to the coupling member 292 by an annular seal member 298. The shunt tube 296 defines a flow passage 300 which communicates with a flow passage 302 of the diverter valve 276.

To provide for cleanout of slurry and proppant that might be blocking sections of the interval annulus 248, it may be desirable to inject clean fluid into the interval annulus 248 at one or more locations. As is evident from FIG. 6, sections of straddle spacer may be employed, with a shunt valve 312 interconnected between each straddle spacer section. As shown in FIG. 6, a lower section 304 of the tubular straddle spacer 268 is connected to the tubular straddle spacer 268 by a threaded connection 306. The lower section 304 defines a plurality of ports 308 through which fluid is vented to the interval annulus 248 in response to fluid flow. The lower section 304 further defines an annular seat 310 within which is seated a port to casing shunt valve 312 that is sealed within the lower tubular straddle spacer section 304 by annular seals 314 and 316. The shunt tube 296 is received within an upper pocket of the shunt valve 312 and is sealed therewith by an annular seal member 318. The shunt valve 312 defines a flow passage 320 communicating the annular passage 266 with a similar annular passage 322 that is defined between the lower section 304 of the tubular straddle spacer 268 and a tubular member 324 that is threaded into the shunt valve 312 and sealed therewith by an annular seal 326. The shunt valve 312 is provided with a valve element 328 that is urged toward its open position by a compression spring 330. Clean fluid being injected at low pressure is shunted to different regions of the interval annulus, depending on the number and location of the shunt valves, and enhances interval cleanout.

As shown in FIG. 7, at the lower end of the lower section 304 of the tubular straddle spacer 268 is connected an inlet mandrel or sub 332 by a threaded connection 334. The inlet mandrel 332 is sealed with respect to the lower section 304 by an annular seal member 336 and defines an inlet port 338.

The inlet port 338 is defined in part by an inclined flow transition surface 340 and is defined in part by an inclined surface 342 of a flexible cup element 344, being a component of a lower cup packer assembly 346. The lower cup packer assembly 346 also includes a rigid cup support member 348 that is sealed with respect to a packer support section 350 of the inlet mandrel 332 by an annular seal member 352. A similar but oppositely facing packer assembly 354, including a rigid packer support 356 and a flexible cup element 358 is located below the lower cup packer assembly to provide for sealing between the straddle tool 210 and the casing 12 when pressure in the casing below the tool becomes elevated.

Within the upper end of the inlet mandrel 332 is provided a flow responsive valve member 360 that defines flow ports 362. The valve member 360 is urged toward its open position by a compression spring 364. The valve member 360 is movable into sealing engagement with tapered surfaces 366 that define a valve outlet opening 368. Consequently, the valve member 360 is opened during conditions of low flow and becomes closed responsive to higher velocity flow of fluid through the flow ports 362.

The inlet mandrel 332 also defines a bypass passage 370 which communicates with the annular passage 266 and a bypass chamber 372 of a tubular bypass section 374 of a bypass sub 376. The bypass sub 376 is threadedly connected to the lower end portion of the packer support section 350 of the inlet mandrel 332. The tubular bypass sub 376 may be identical with the tubular bypass sub 126 of FIG. 3 and defines entrance ports 378 that communicate with the annulus 380 across an entrance screen 382. The entrance screen 382 is secured in place by a screen retainer member 384. Below the tubular bypass sub 376 the straddle tool 210 is typically of the configuration and function shown in FIG. 4.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

We claim:

1. A method for cleaning an interval of a well having a casing, comprising:

with a tubing conveyed straddle tool having spaced packer elements positioned within the well casing establishing an annular interval between the spaced packer elements and between the straddle tool and the casing, causing a flow of clean fluid through the tubing and said straddle tool into an upper portion of the annular interval via an outlet port of said straddle tool and thence from a lower portion of the annular interval into the straddle tool via an inlet port located below said outlet port;

at a fluid flow rate above a predetermined flow rate, blocking the flow of fluid into the casing below said spaced packer elements and permitting fluid pressurization of the annular interval for formation interval treatment; and at a fluid flow rate up to the predetermined flow rate, directing fluid flow through said inlet port into the well casing below said spaced packer elements.

2. The method of claim 1, further comprising:

displacing any excess fluid from the casing below said spaced packer elements through at least one bypass passage of said straddle tool into the casing above said spaced packer elements.

3. The method of claim 1, further comprising:

diverting the flow of fluid from said straddle tool through said outlet port along a flow path having bends less than 90 degrees to minimize erosion of tool components and to minimize erosion of the casing opposite said outlet port.

4. The method of claim 1, wherein a flow diverter member is positioned within said straddle tool at said outlet port and defines a fluid flow diverting geometry diverting fluid flow at a gradual angle into the annular interval, said method further comprising:

during flow of fluid from said straddle tool, diverting the flow of fluid with said fluid flow diverting geometry along a flow path having bends less than 90 degrees and minimizing erosion of said outlet port.

5. The method of claim 4, wherein said flow diverter member is composed at least partially of a material having a predetermined sacrificial rate of erosion by abrasive fluid, said method further comprising:

during flow of fluid from said outlet port into the annular interval, substantially confining erosion to sacrificial erosion of said flow diverter member.

6. The method of claim 1, wherein the structure of said straddle tool further integrates a bypass passage permitting internal fluid flow passages thereof to be of sufficiently large diameter to minimize the velocity of fluid flow therethrough, said method further comprising:

at a predetermined rate of flow through said straddle tool, causing the velocity of fluid flow to be sufficiently low to minimize fluid flow induced erosion of tool components.

7. The method of claim 1, wherein said spaced packer elements comprise upper and lower cup packers each having a flexible cup element defining an annular cup skirt, said method further comprising:

during fluid flow from said annular interval through said inlet port, directing fluid flow into said annular cup skirt of said lower cup packer and causing fluid flow cleaning of said lower cup packer of treatment fluid residue.

8. A method for treatment of an interval of a well having a well casing and cleaning treatment residue from the interval, comprising:

running a straddle tool having spaced packer elements into the well casing on a fluid supplying tubing string and defining an annular sealed interval between the spaced packer elements and between the straddle tool and the well casing, the straddle tool having an upper outlet port and a lower inlet port each being in communication with the annular sealed interval, a pressure responsive valve open to the annular sealed interval and to the well casing below said spaced packer elements at a predetermined rate of fluid flow and closed to the well casing below said spaced packer elements at a rate of fluid flow exceeding said predetermined rate of fluid flow;

pumping treatment fluid through the fluid supplying tubing string through said outlet port and into the annular sealed interval at a flow rate maintaining said pressure responsive valve closed and subjecting the annular sealed interval to desired treatment;

upon completion of annular sealed interval treatment, causing flow of clean fluid through said tubing string at a rate sufficient to permit said pressure responsive valve to open and dump treatment fluid and clean fluid from the annular sealed interval into the well casing;

continuing the flow of clean fluid through said tubing string, through said outlet port, through the annular sealed interval, and through said inlet port at a flow rate maintaining said pressure responsive valve open and cleaning said formation treatment tool and the annular sealed interval; and bypassing clean fluid through a bypass passage from the well casing below said spaced packer elements to the well casing above said spaced packer elements as necessary to remove fluid filling the well casing below said formation tool.

9. The method of claim 8, further comprising:

maintaining fluid flow at a sufficiently low velocity to minimize fluid flow induced erosion of said upper outlet port and said lower inlet port.

10. The method of claim 8, wherein a flow diverter member is positioned within said straddle tool at said outlet port and defines a fluid flow diverting geometry, said method further comprising:

diverting the flow of fluid with said fluid flow diverting geometry along a flow path having bends less than 90 degrees and minimizing abrasive fluid erosion of said outlet port, lower inlet port, and the well casing.

11. The method of claim 10, further comprising:

permitting fluid flow induced erosion of said flow diverter member at a predetermined rate.

12. The method of claim 8, wherein said spaced packer elements comprise upper and lower cup packers each having a flexible cup element defining an annular cup skirt, said method further comprising:

during clean fluid flow from said annular sealed interval through said inlet port, directing at least some of said clean fluid flow within said annular cup skirt of said lower packer and cleaning the interior of said annular cup skirt of any treatment fluid residue.

13. Apparatus for cleaning a selected interval within a well having a well casing perforated at the selected interval, comprising:

a formation treatment tool defining a fluid supply passage and a dump passage and being conveyed by fluid supplying tubing to the selected interval, said fluid supply passage being in communication with the fluid supplying tubing;

spaced straddle packer elements supported by said formation treatment tool and defining the selected interval within the well casing;

an outlet port defined by said formation treatment tool and communicating said fluid supply passage with the selected interval between said spaced straddle packer elements and the well casing and an inlet port communicating the selected interval with said dump passage;

a dump valve in communication with said dump passage, said dump valve being open for draining fluid from the fluid supplying tubing and fluid supply passage and selected interval and dump passage within a predetermined range of low fluid flow and closed when fluid flow is above said predetermined range of low fluid flow; and a bypass passage extending through said formation treatment tool and having bypass inlet and outlet openings in communication with the well casing outside the selected interval.

14. The apparatus of claim 13, wherein:

at least one of said outlet port and said inlet port define flow transitioning geometry establishing gradual transition of fluid flow relative to the selected interval.

15. The apparatus of claim 14, wherein said flow transitioning geometry comprises:

inclined outlet port surfaces establishing gentle angular transition of fluid flow from said fluid supply passage through said outlet port and into the selected interval.

16. The apparatus of claim 15, wherein:

said inclined outlet port surfaces are sufficiently spaced to define an outlet port opening having a cross-sectional dimension at least as great as the cross-sectional dimension of said fluid supply passage and minimizing the velocity of fluid flow through said outlet port.

17. The apparatus of claim 14, further comprising:

a flow diverter member located within said formation treatment tool and having an end defining a flow diverting geometry diverting fluid flow from said fluid supply passage to said outlet port along a flow path having bends less than 90 degrees.

18. The apparatus of claim 17, wherein:

said flow diverter member is composed of a material having characteristics of controlled erosion by formation treatment fluid.

19. The apparatus of claim 13, wherein:

said spaced straddle packer elements comprise upper and lower cup packer elements each defining a resilient packer cup, said lower packer cup defining a fluid flow transition portion of said inlet port and transitioning fluid flow from said selected interval through said inlet port.

20. The apparatus of claim 13, wherein:

said lower packer cup is positioned and oriented for internal cleaning thereof by clean fluid flowing through said inlet port from said selected interval.

21. The apparatus of claim 13, wherein:

said formation treatment tool has upper and lower ends;

said spaced straddle packer elements comprise upper and lower cup packer elements, said upper cup packer element is located near said upper end of said formation treatment tool and said lower cup packer element is located near said lower end of said formation treatment tool; and said outlet port is located immediately below said upper cup packer element and said inlet port is located immediately above said lower cup packer element and in position for cleaning of said lower cup packer element by fluid flowing through said inlet port.

22. The apparatus of claim 13, further comprising:

filter members positioned to filter out particulate from fluid flowing into and from said inlet and outlet bypass openings.

23. The apparatus of claim 13, wherein:

said dump valve has dump ports and a valve seat, and comprises a dump valve actuator having a valve element having an open position permitting flow of fluid from said dump passage through said dump ports and being movable to a closed position with said valve element in engagement with said valve seat blocking flow from said dump passage through said dump ports.

24. The apparatus of claim 23, wherein:

said dump valve actuator defines a flow passage therethough, and further comprises an urging member applying an urging force to said dump valve actuator urging said dump valve actuator toward said open position; and an orifice located within said flow passage of said dump valve actuator developing a resultant force acting on said dump valve actuator in opposition to said urging force responsive to flow of fluid through said orifice, said resultant force moving said dump valve actuator to a position closing said dump valve when fluid flow through said orifice reaches a predetermined rate.

25. A straddle tool for treating selected intervals in wells having a well casing, comprising:

an outlet mandrel having a fluid supply passage and defining an outlet port through which fluid flows from said fluid supply passage into a selected interval annulus between the well casing and said straddle tool;

an upper packer mounted to said outlet mandrel immediately above said outlet port establishing sealing of said outlet mandrel with the well casing;

an inlet mandrel having a fluid dump passage and located below said outlet mandrel, said inlet mandrel defining an inlet port through which fluid flows from the selected interval annulus into said fluid dump passage;

a lower packer mounted to said inlet mandrel establishing sealing of said inlet mandrel with the well casing;

a pressure responsive dump valve controlling flow of fluid through said fluid dump passage and being open to permit flow when the fluid flow rate is below a predetermined flow rate and being closed to block flow when the fluid flow rate is above the predetermined flow rate; and a bypass passage defined by said straddle tool and having bypass openings in communication with the casing-tool annulus above and below said upper and lower packers.

26. The straddle tool of claim 25, further comprising:

a tubular straddle spacer member interconnecting said outlet mandrel and said inlet mandrel and being of sufficient length to cause sealing of said upper and lower packers with said well casing above and below the selected interval.

27. The straddle tool of claim 26, wherein:

said tubular straddle spacer member is composed of a plurality of interconnected straddle spacer sections and defines an overall tool length accommodating the length of the selected interval.

28. The straddle tool of claim 26, further comprising:

a shunt tube located within said tubular straddle spacer member and defining a shunt flow passage in communication with said fluid dump passage;

at least one shunt valve located intermediate the length of said shunt tube and ported through said tubular straddle spacer member to the casing-tool annulus of the selected interval; and wherein said dump valve is in communication with said shunt flow passage.

* * * * *